US006322285B1

(12) United States Patent
Ben

(10) Patent No.: US 6,322,285 B1
(45) Date of Patent: Nov. 27, 2001

(54) REMOVABLE VEHICLE BARRIER

(76) Inventor: Yossi Ben, Moshav Zofar, Mobile Post Arava 86830 (IL)

( * ) Notice: Subject to any disclaimer, the term of this patent is extended or adjusted under 35 U.S.C. 154(b) by 0 days.

(21) Appl. No.: 09/621,963

(22) Filed: Jul. 21, 2000

(30) Foreign Application Priority Data

Jul. 23, 1999 (IL) ..... 131073

(51) Int. Cl.[7] ..... E01F 15/10
(52) U.S. Cl. ..... 404/6
(58) Field of Search ..... 404/6; 256/13.1, 256/1

(56) References Cited

U.S. PATENT DOCUMENTS

| | | | | |
|---|---|---|---|---|
| 4,382,714 | | 5/1983 | Hutchinson . | |
| 4,995,756 | * | 2/1991 | Kilgrow et al. | 404/6 |
| 5,123,774 | | 6/1992 | Dubiel . | |
| 5,322,385 | * | 6/1994 | Reisman | 404/6 |
| 5,482,397 | | 1/1996 | Soleau . | |
| 5,507,588 | | 4/1996 | Marts . | |
| 5,611,408 | | 3/1997 | Abukhader . | |

FOREIGN PATENT DOCUMENTS

| | | | | |
|---|---|---|---|---|
| 195 09 404 C1 | * | 8/1996 | (DE) | E01F/13/12 |

OTHER PUBLICATIONS

English Abstract w/2 sheets of drawings (Figs. 1–5) re: Japanese Patent No 11–036249 published Feb. 9, 1999 (Japan Aircraft Mfg. Co. Ltd.) E01F 13/00.

* cited by examiner

*Primary Examiner*—Thomas B. Will
*Assistant Examiner*—Kristine Markovich
(74) *Attorney, Agent, or Firm*—Breiner & Breiner, L.L.C.

(57) ABSTRACT

A removable vehicle barrier for stopping a moving vehicle, which includes at least one high tensile strength filament disposed transverse to the direction of vehicle movement, having spaced-apart tire adhesion elements attached to the filament, the adhesion elements being provided with lower spike plates for attaching themselves to the tires of a moving vehicle when the vehicle passes over the barrier, thereby winding the filament around a component of the vehicle underside and effecting the halting of the vehicle. The lower spike plates are covered to allow passage thereover by a vehicle front wheel without engaging the filament, front wheel passage causing exposure of the lower spike plates which then attach themselves to the rear wheels of the vehicle.

9 Claims, 3 Drawing Sheets

10
14
16
14
16
14
16
14
12

28
32
34
34
34
30

20
14
22
24
26
12
10
14
24
22

38
40
36

REMOVABLE VEHICLE BARRIER

The present invention relates to an apparatus for arresting a fleeing vehicle.

More particularly, the invention provides a portable and removable barrier which self-attaches to a fleeing car or truck and arrests same by causing locking of two wheels.

The present application is not concerned with fixed location barriers, as these can readily be configured to stop any vehicle.

The problem of how to stop the escape of a fugitive vehicle, for law enforcement or military purposes, has been well defined by Hutchinson in the foreword to U.S. Pat. No. 4,382,714. Portable barricades often fail when a vehicle crashes therethrough and continues on its way. Alternatively two or more police vehicles are parked across the road to form a road block. Quite often serious collisions occur as a result, causing injury to law enforcement personnel as well as to the fugitives, and severe damage to police vehicles. A further drawback of such methods is the requirement for about 5 or 6 law enforcement personnel to maintain the barricade.

Barrier failure is likely to lead to the use of firearms by police or armed forces which may injure bystanders, or fail to stop the fleeing vehicle, or possibly kill those riding in said vehicle who may be guilty of no crime more severe than for example driving with expired third party insurance.

In order to at least slow down a fleeing vehicle, various systems have been proposed for puncturing the tires of such vehicle when driven through a barrier. Such proposals are described and claimed in the following U.S. Patents:

U.S. Pat. No. 4,382,714 to Hutchinson, U.S. Pat. No. 5,123,774 to Dubiel, U.S. Pat. No. 5,482,397 to Soleau, U.S. Pat. No. 5,507,588 to Marts et al, and U.S. Pat. No. 5,611,408 to Abukhader. These documents also make reference to a large number of earlier designs.

A limitation of tire puncturing devices is that a vehicle riding on ordinary tires can still be driven, though at reduced speed, after tire deflation. The development of "run-flat" tires has however made prior-art puncturing devices practically useless. MACHINE DESIGN reported on Jul. 21, 1988 that the Ford HFX Ghia Aerostar has "run-flat" tires. The Goodyear company has long operated an aggressive program to develop such tires. Presently this company offers the "Eagle Aquasteel Run-Flat" tire for passenger cars which is designed to be driven with no air pressure for up to 50 miles at 55 mph. Tires of this type have been so successful that for 1997 General Motors marketed the Plymouth Prowler without a spare wheel or tire changing equipment. Clearly, the puncturing of tires can no longer be relied upon to stop a fugitive vehicle.

It is therefore one of the objects of the present invention to obviate the disadvantages of prior art vehicle barriers and to provide an apparatus which arrests a vehicle driven through a removable barrier without danger to law enforcement personnel or property.

It is a further object of the present invention to arrest such vehicle whether or not it is fitted with "run-flat" tires.

It is yet a further object of the invention to arrest a fugitive vehicle Without harming its occupants.

The present invention achieves the above objects by providing a removable vehicle barrier for stopping a moving vehicle, comprising at least one high tensile strength filament disposed transverse to the direction of vehicle movement, having spaced-apart tire adhesion elements attached to said filament, said adhesion elements being provided with adhesion means for attaching themselves to the tires of a moving vehicle when said vehicle passes over said barrier, thereby winding said at least one filament around a component of the vehicle underside and effecting the halting of said vehicle, characterized in that said adhesion means are covered to allow passage thereover by a vehicle front wheel without engaging said filament, front wheel passage causing exposure of said adhesion means which then attach themselves to the rear wheels of said vehicle.

In a preferred embodiment of the present invention there is provided a vehicle barrier wherein said adhesion means are spiked plates or spikes.

In especially preferred embodiments of the present invention, said covering means are also provided with adhesion means which attach themselves to the front wheels of said vehicle without substantially interfering therewith.

Said adhesion means which are provided on said covering means, are preferably selected from the group consisting of spiked plates, spikes or glue.

It will thus be realized that the novel device of the present invention serves to lock the rear vehicle wheels as the high strength filament connecting two tire-adhering elements becomes tensioned, typically due to engagement with the vehicle differential housing or the driveshaft.

The sudden halting of the vehicle also provides an element of shock to its driver and passengers, which could provide police with the few extra seconds needed to make arrests.

As it is not the aim of the present device to harm the vehicle occupants, there is provided a device which locks the vehicle rear wheels. This is advantageous, as locking the front wheels could possibly cause the fleeing vehicle to overturn.

In JP 11036249 by Japan Aircraft Mfg. Co. Ltd., there is described and claimed a vehicle block net comprising a plurality of glass fiber cloth sewn on one side of a turnable rectangular sheet-like net and having an adhesive for making the fiber cloth adhere to a tire when the net is laid on a road surface, whereby after the fiber cloth sticks to the tire of the vehicle which has passed thereon, the net gets twisted around the tire.

As explained and stated hereinbefore, this solution is not acceptable to law enforcement and other users since it could possibly cause serious or even fatal injury to the occupants of a vehicle which is overturned due to the locking of its front wheels.

With regard to the high strength filament, it would seem at first glance that a steel cable would be the obvious choice. Surprisingly, other materials are preferable. In operation the filament is exposed to a sudden high tensile force when the filament terminals are wrapped partly around the tires and the central portion of the filament engages a component on the vehicle underside, for example the differential casing. Such sudden application of a high force is likely to snap a steel cable of moderate diameter, or if a heavier cable is used cause dislodgment of or from the adhesive element, or of the element from the tire. Thus a better choice is a web made of a high strength plastic fiber, which allows about 50% elongation, during the course of which elongation kinetic energy is absorbed over a longer time period, for example about 2 seconds instead of about 0.3 seconds which could be expected with a steel cable. Obviously the forces which need to be withstood by the apparatus arising from sudden locking of the wheels are far higher than those arising when the kinetic energy is absorbed over a longer period.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
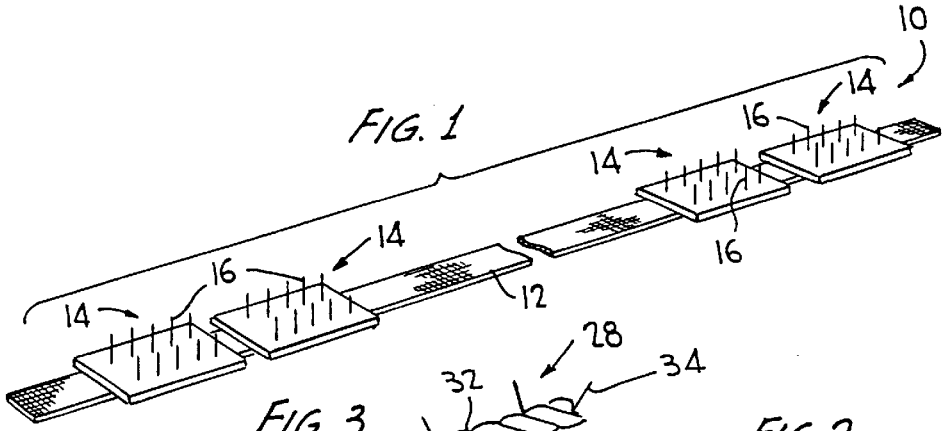
FIG. 1 is a perspective view of a preferred embodiment of the barrier according to the invention.

There is seen in FIG. 1 a portable and removable vehicle barrier 10, suitable for police or military use, for stopping a moving vehicle, the driver of which is attempting to escape by driving through the deployed barrier.

A high tensile strength filament 12 is disposed transverse to the direction of vehicle movement, indicated by an arrow on the diagram. In the present embodiment the filament 12 is a woven web made of plastic fibers, for example polyester, nylon or aramid.

Firmly attached to the filament 12 is a plurality of spaced-apart tire adhesion elements 14.

Spacing of the elements 14 is arranged so that a vehicle traversing the barrier must contact at least one of the elements 14 with both right and left wheels respectively.

Adhesion elements 14 are provided with adhesion means for attaching themselves to the tires of a moving vehicle as the vehicle passes over the barrier 10. In the present embodiment the adhesion elements 14 comprise spiked plates.

In the present embodiment the spikes 16 serve the additional purpose of attaching the filament 12 to the plates 18.

As will be seen in the following figure, the spikes 16 pierce the vehicle tires and thereby attach at least one of the elements 14 to each of an opposite pair of tires. Additionally, the spikes 16 deflate the pierced tires.

This embodiment and the embodiments of FIGS. 3, 5, and 8, as described hereinafter, are intended for use with a further element such as free upper spiked plate 60 which is described with reference to the discussion of FIG. 6 hereinafter or with a covering means having an upper face which is coated with glue 38, such as described with reference to FIG. 4.

With reference to the rest of the figures, similar reference numerals have been used to identify similar parts.

Figure 2:
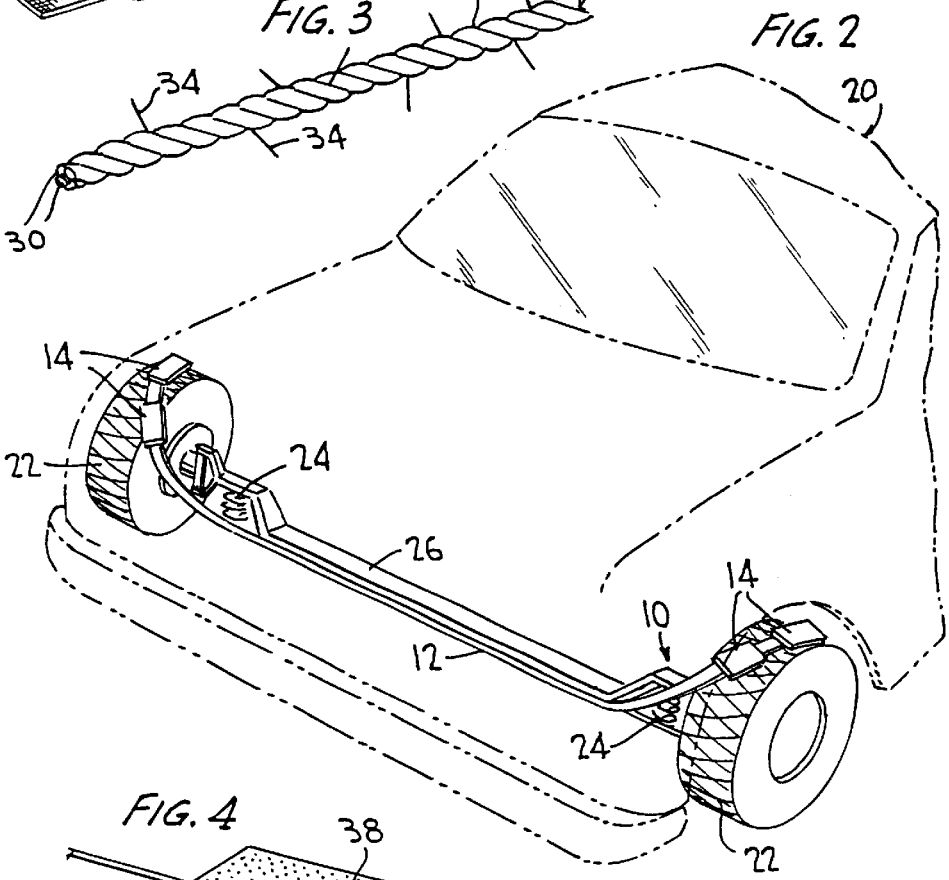
FIG. 2 is a pictorial view of a the barrier in use, showing a vehicle which has been driven thereover.

Referring now to FIG. 2, there is seen the same embodiment together with a wheeled vehicle 20 which has been driven across the barrier 10.

Adhesion elements 14, spiked plates in the shown embodiment, attach themselves to the tires 22 of the moving vehicle as vehicle 20 passes over the barrier 10. Due to revolution of the vehicle wheels, the connecting filament 12 is also revolved about an axis joining the wheel centers. Almost immediately in attempting such winding the filament 12 strikes and is stopped by a component of the vehicle underside, typically the differential casing 24 as shown in the diagram, or the drive-shaft 26 connected thereto, resulting in tensioning of the filament 12 as the wheels revolve. The wheels are thus prevented from further rotation, and effect the halting of the vehicle 20.

FIG. 2 illustrates a situation where the barrier is engaged with the rear wheels. A similar situation occurs when the front wheels are engaged with the barrier 10, the only difference being that the filament 12 engages some part of the front wheel suspension instead of the differential casing.

Figure 3:
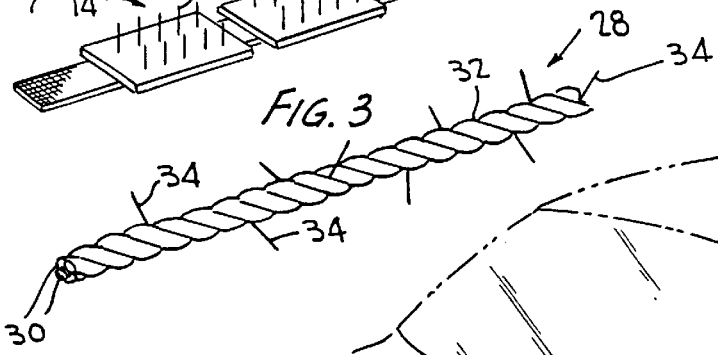
FIG. 3 is a perspective view of a detail of an embodiment where several filaments are formed into a cable, which supports a plurality of spikes.

FIG. 3 illustrates an embodiment 28 wherein a plurality of high tensile strength filaments 30 have been formed into a cable 32. The cable 32 carries multiple spikes 34 disposed at random orientation around the cable, which pierce the tires of a vehicle driven there-across, and thus attach the cable 32 to the tires 22 in a manner seen in FIG. 2.

Figure 4:
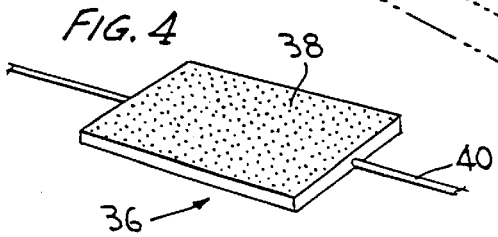
FIG. 4 is a perspective view of a tire adhesion element using glue.

Seen in FIG. 4 is a tire adhesion element 36, the upper face of which is coated with glue 38.

Advantageously the glue 38 is a medical-type silicon glue, which is has been found to be moisture and dirt resistant.

In the present embodiment the filament comprises a metal cable 40.

Figure 5:
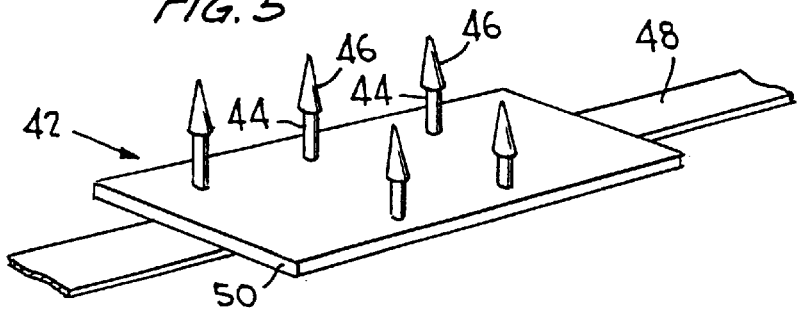
FIG. 5 is a detail perspective view of a preferred form of spike.

Referring now to FIG. 5, there is depicted an adhesion element 42 which has been tested to be particularly effective in the present application. Adhesion means comprises steel spikes 44 between 2 to 3.5 cm high. The spikes 44 are provided with an arrow head 46, which in operation lodges itself against the inner wall of the tire rolling thereover.

In the present embodiment a high strength filament 48 made of cotton fibers. The filament 48 is firmly attached to the lower face of the plate 50 supporting the spikes 44.

Figure 6:
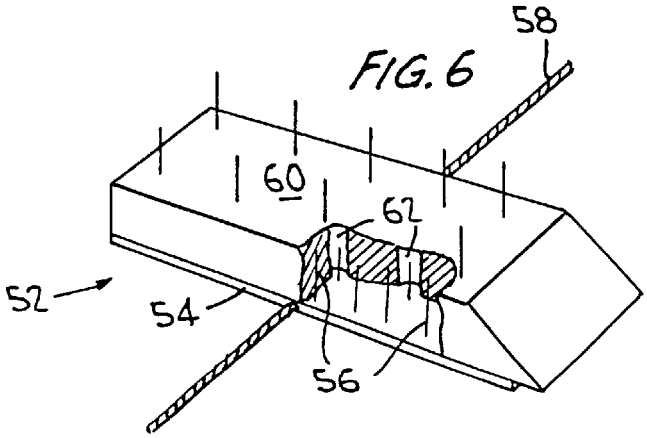
FIG. 6 is a perspective view of a detail of a preferred embodiment which locks only the rear wheels of a vehicle crossing the barrier.

FIG. 6 shows a detail of a vehicle barrier 52 configured to lock the rear wheels of a vehicle passing thereover.

Figure 7:
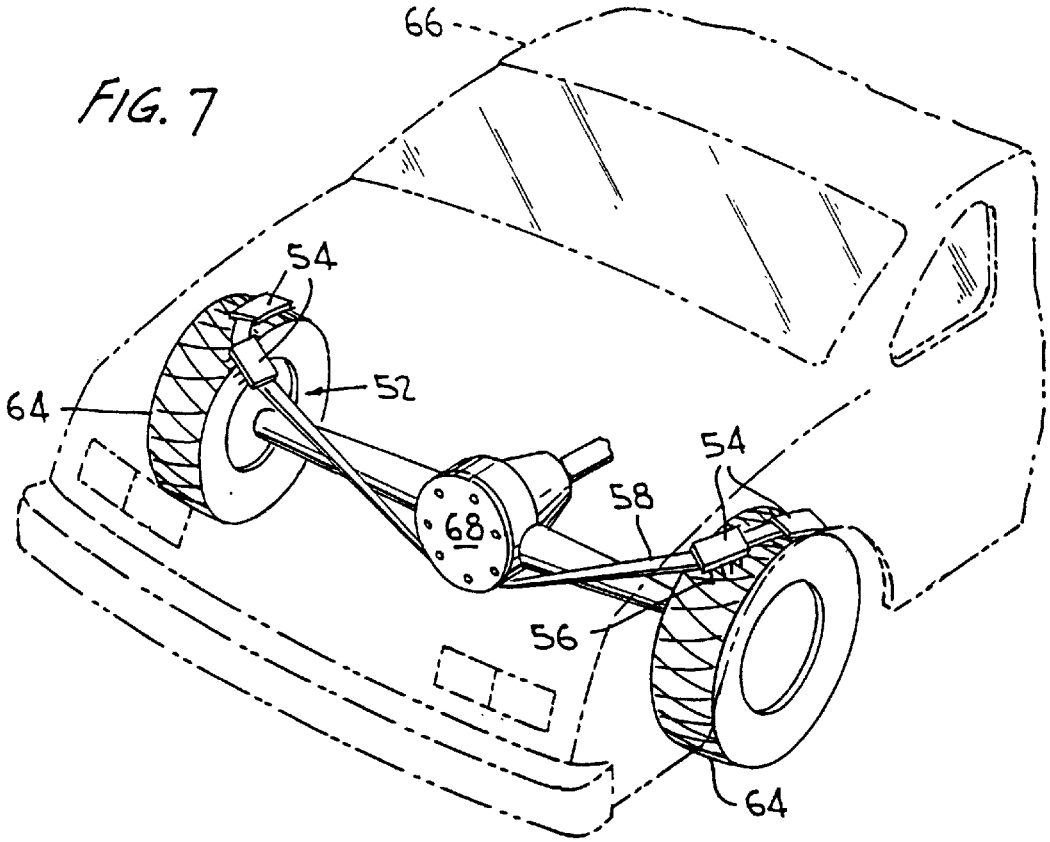
FIG. 7 is a pictorial view of the barrier shown in FIG. 6 in use.

FIG. 7 shows vehicle barrier 52 locked to the rear wheel of a vehicle which has passed over barrier 52.

The adhesion means in this embodiment comprises the lower plate 54 carrying multiple spikes 56, which will engage the rear wheels, and is covered to allow passage thereover by a vehicle front wheel, which passage is effected without engaging the lower plate 54 or the filaments 58 connected thereto.

Front wheel passage causes a free upper spiked plate 60 to pierce the front tires and to adhere thereto. The front tires thus carry away the free upper spiked plate 60, and by doing so expose adhesion means, a lower spiked plate 54 attached to filaments 58 which are a pair of cables in the present embodiment. Thus the lower spiked plate 54 then attaches itself to the rear wheels of the vehicle, causing halting of the vehicle as seen in FIG. 2.

The advantage gained by the present embodiment lies in preventing overturning of the vehicle being arrested, which could occur as a result of locking the front wheels of a short, light-weight vehicle.

The shown embodiment is one of several possible methods of ensuring that the vehicle rear wheels will be locked. Other means (not shown) of achieving the same end is to arrange for the front wheels to actuate a triggering mechanism which exposes previously hidden spikes.

Figure 8:
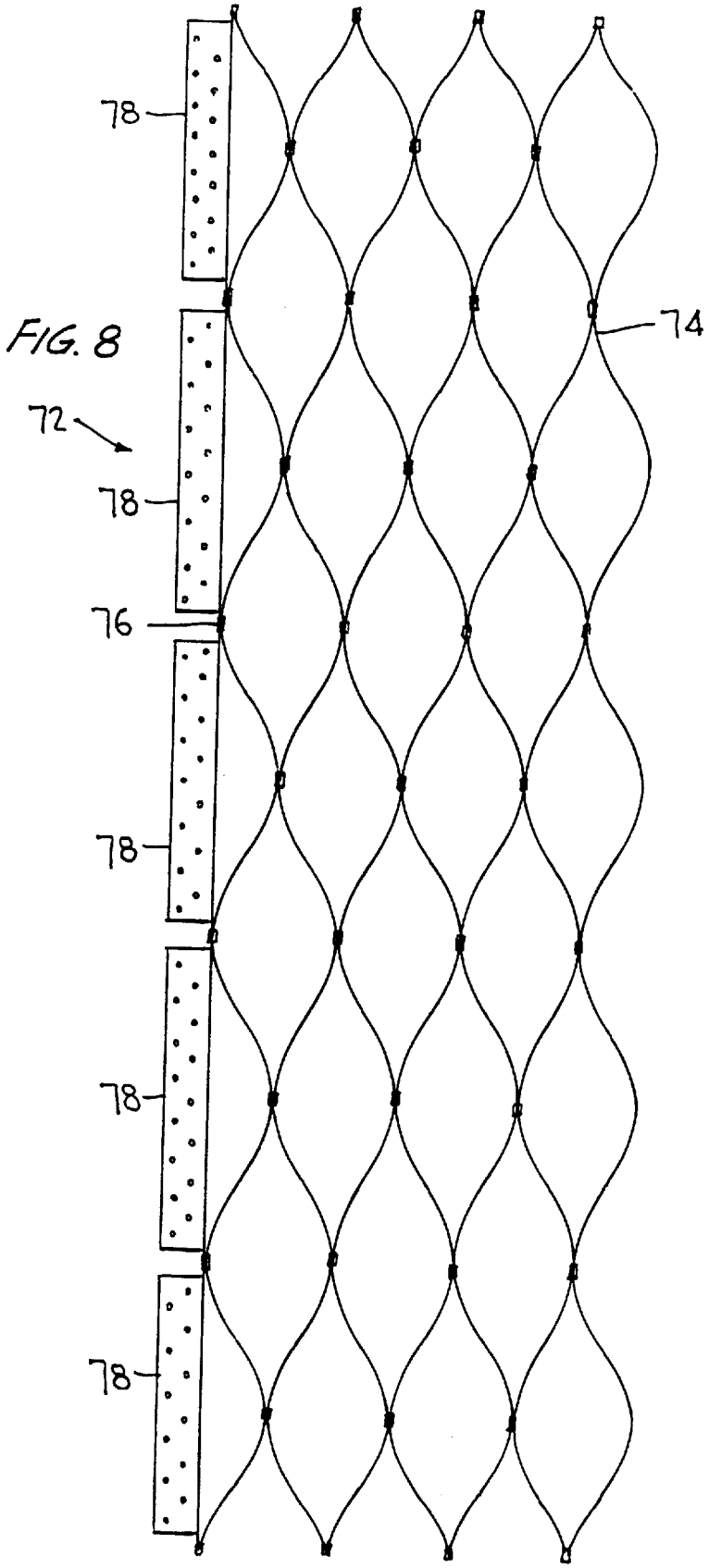
FIG. 8 is a plan view of an embodiment using netting as the filament.

FIG. 8 illustrates a vehicle barrier 72 wherein the high-strength filament is formed into a netting 74. The netting 74 is firmly anchored in the present embodiment to a cable 76 connecting a plurality of spiked plates 78 in series. The preferred mode of deployment is to arrange for the netting 74 to be on the side of the spiked plates 78 opposite to that from which a vehicle to be stopped approaches. Similarly to that shown in FIG. 2, after the spiked plates 78 engage the tires, the netting becomes entangled with some part of the vehicle underside to lock two vehicle wheels.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A removable vehicle barrier for stopping a moving vehicle moving on wheels fitted with tires, comprising at least one high tensile strength filament disposed transverse to the direction of vehicle movement, having spaced-apart tire adhesion elements attached to said filament, said adhesion elements being provided with adhesion means for attaching themselves to the tires of said moving vehicle when said vehicle passes over said barrier, thereby winding said at least one filament around a component of the vehicle underside and effecting the halting of said vehicle, wherein said adhesion means are overlaid with a covering means to allow passage thereover by a vehicle front wheel without engaging said filament, front wheel passage causing exposure of said adhesion means which then attach themselves to the rear wheels of said vehicle.

2. A vehicle barrier according to claim 1, wherein said adhesion means are selected from the group consisting of spiked plates and spikes.

3. A vehicle barrier according to claim 2, wherein said adhesion means comprises steel spikes between 2 to 3.5 cm high, said spikes being provided with an arrow head.

4. A vehicle barrier according to claim 1, wherein said adhesion means comprises medical-type silicon glue.

5. A vehicle barrier according to claim 1, wherein said filament is made from a material selected from the group consisting of plastic fibers, cotton fibers and metal.

6. A vehicle barrier according to claim 1, comprising a plurality of high tensile strength filaments formed into a cable.

7. A vehicle barrier according to claim 1, wherein said filament is formed into a netting.

8. A vehicle barrier according to claim 1 wherein said covering means are also provided with said adhesion means which attach themselves to the front wheels of said vehicle without substantially interfering therewith.

9. A vehicle barrier according to claim 8, wherein said adhesion means are selected from the group consisting of spiked plates, spikes and glue.

* * * * *